US007837387B2

(12) United States Patent
Newrones et al.

(10) Patent No.: US 7,837,387 B2
(45) Date of Patent: Nov. 23, 2010

(54) EVACUATABLE CONTAINER

(75) Inventors: Roland Newrones, Brecksville, OH (US); Richard L. Sandt, Brunswick, OH (US)

(73) Assignee: Avery Dennison Corporation, Pasadena, CA (US)

( * ) Notice: Subject to any disclaimer, the term of this patent is extended or adjusted under 35 U.S.C. 154(b) by 1104 days.

(21) Appl. No.: 11/100,301

(22) Filed: Apr. 6, 2005

(65) Prior Publication Data

US 2006/0228057 A1 Oct. 12, 2006

(51) Int. Cl.
*B65D 33/01* (2006.01)

(52) U.S. Cl. ..... 383/103

(58) Field of Classification Search ..... 383/103, 383/45, 42, 100, 66, 105; 53/84
See application file for complete search history.

(56) References Cited

U.S. PATENT DOCUMENTS

| | | | | | |
|---|---|---|---|---|---|
| 2,927,722 | A | * | 3/1960 | Metzger | 383/103 |
| 3,369,709 | A | * | 2/1968 | Clauss | 222/107 |
| 3,399,822 | A | * | 9/1968 | Kugler | 383/103 |
| 3,468,471 | A | * | 9/1969 | Linder | 206/439 |
| 4,000,846 | A | * | 1/1977 | Gilbert | 383/103 |
| 4,215,791 | A | | 8/1980 | Brochman | |
| 4,405,056 | A | | 9/1983 | Patterson | |
| 4,497,431 | A | * | 2/1985 | Fay | 383/103 |
| 4,705,186 | A | | 11/1987 | Barrash | |
| 4,712,249 | A | | 12/1987 | Gannon | |
| 4,715,494 | A | * | 12/1987 | Heitzenroder et al. | 206/213.1 |
| 4,790,436 | A | * | 12/1988 | Nakamura | 206/449 |
| 5,035,103 | A | | 7/1991 | Akkala | |
| 5,142,970 | A | | 9/1992 | ErkenBrack | |
| 5,240,112 | A | | 8/1993 | Newburger | |
| 5,261,532 | A | | 11/1993 | Fauci | |
| 5,332,095 | A | | 7/1994 | Wu | |
| 5,388,910 | A | | 2/1995 | Koyanagi | |
| 5,445,870 | A | * | 8/1995 | Buchner et al. | 428/214 |
| 5,450,963 | A | | 9/1995 | Carson | |
| 5,480,030 | A | | 1/1996 | Sweeney et al. | |
| 5,515,975 | A | | 5/1996 | Jarvis et al. | |
| 5,584,409 | A | * | 12/1996 | Chemberlen | 220/89.1 |
| 5,727,881 | A | * | 3/1998 | Domke | 383/103 |

(Continued)

FOREIGN PATENT DOCUMENTS

| | | |
|---|---|---|
| EP | 494 559 | 7/1992 |

(Continued)

OTHER PUBLICATIONS

PCT/US2006/012516; Results of Partial International Search mailed Jul. 24, 2006.

*Primary Examiner*—Jes F Pascua

(57) ABSTRACT

A container (10) having a valve flap (20) which is movable between a closed position, whereat it is seated on the seating area (18) to close an evacuation port (16), and an opened position, whereat it is unseated from the seating area (18) to open the evacuation port (16). A label structure (26) includes a film layer (28) forming a seat platform on which a seating area (18) is located and/or a film layer (30) forming a flap platform on which the valve flap (20) is located. A plurality of label structures (26) can be efficiently and economically mass-produced by a label-manufacturer and then supplied to the container-manufacturer for incorporation into the containers (10).

16 Claims, 14 Drawing Sheets

U.S. PATENT DOCUMENTS

| | | | | |
|---|---|---|---|---|
| 5,806,703 | A * | 9/1998 | Grandi | 220/203.15 |
| 5,839,582 | A | 11/1998 | Strong et al. | |
| 5,881,881 | A | 3/1999 | Carrington | |
| 5,894,929 | A | 4/1999 | Kai et al. | |
| 5,955,127 | A * | 9/1999 | Glaser | 426/106 |
| 5,989,608 | A * | 11/1999 | Mizuno | 426/113 |
| 5,996,800 | A | 12/1999 | Pratt | |
| 6,039,182 | A | 3/2000 | Light | |
| 6,056,439 | A | 5/2000 | Graham | |
| 6,059,457 | A | 5/2000 | Sprehe et al. | |
| 6,070,397 | A | 6/2000 | Bachhuber | |
| 6,194,011 | B1 | 2/2001 | Glaser | |
| 6,357,915 | B2 | 3/2002 | Anderson | |
| 6,378,272 | B1 * | 4/2002 | Archibald et al. | 53/412 |
| 6,437,305 | B1 | 8/2002 | Haamer | |
| 6,604,634 | B2 | 8/2003 | Su | |
| 6,662,827 | B1 * | 12/2003 | Clougherty et al. | 383/103 |
| 6,663,284 | B2 * | 12/2003 | Buckingham et al. | 383/103 |
| 6,729,473 | B2 | 5/2004 | Anderson | |
| 6,983,845 | B2 * | 1/2006 | Shah et al. | 383/103 |
| 7,051,762 | B2 * | 5/2006 | Haamer | 137/855 |
| 7,178,555 | B2 * | 2/2007 | Engel et al. | 137/852 |
| 2004/0000501 | A1 * | 1/2004 | Shah et al. | 383/103 |
| 2004/0000502 | A1 | 1/2004 | Shah et al. | |
| 2004/0007494 | A1 | 1/2004 | Popeil et al. | |
| 2006/0050999 | A1 * | 3/2006 | Blythe et al. | 383/63 |

FOREIGN PATENT DOCUMENTS

| | | |
|---|---|---|
| JP | 3-212355 | 9/1991 |
| JP | 08198274 | 8/1996 |
| JP | 2000118540 | 4/2000 |
| WO | 99/19919 | 4/1999 |
| WO | 2004/045985 | 6/2004 |
| WO | WO 2004106190 A1 * | 12/2004 |

* cited by examiner

EVACUATABLE CONTAINER

FIELD OF THE INVENTION

The present invention relates generally, as indicated, to an evacuatable container and, more particularly, to a container having an evacuation port that is opened to remove gas from the container and sealed once gas removal is complete.

BACKGROUND OF THE INVENTION

A container, such as a flexible plastic bag, is often used as a receptacle to contain a commodity. To provide optimum storage conditions for the commodity, it is often desirable for gas (e.g., air) to be removed from the receptacle. If so, the container can include an evacuation port through which gas can pass from the receptacle to the outside environment. Valving can be incorporated into the container to allow the evacuation port to be opened during gas removing steps and closed thereafter to maintain the evacuated condition of the receptacle.

SUMMARY OF THE INVENTION

An evacuatable container includes a label structure providing an openable/closeable valve flap and/or a seating area for such a valve flap. A plurality of the label structures can be efficiently and economically mass-produced separately from the manufacture of the rest of the container and incorporated therewith during latter manufacturing stages. Moreover, the incorporation of the label structure into the container is compatible with conventional container-making and container-filling techniques whereby, quite significantly, this incorporation will not significantly compromise conventional (and typically quick) manufacturing speeds.

More particularly, the container comprises a wall structure defining a receptacle, an evacuation port through which gas can pass from the receptacle to an outside environment, a seating area, and a valve flap. The valve flap has a movable portion which is movable between a closed position whereat it is seated on the seating area to close the evacuation port and an opened position whereat it is unseated from the seating area to open the evacuation port. A seating adhesive, on the seating area, holds the valve flap in the closed position.

A label structure, attached to the wall structure includes a film layer forming a seat platform on which the seating area is located and/or a film layer forming a flap platform on which the valve flap is located. In a first embodiment, the label structure includes both a film layer forming a seat platform on which the seating area is located and a film layer forming a flap platform on which the valve flap is located. In a second embodiment, the valve flap is formed in the wall structure and the label structure includes the film layer forming a seat platform on which the seating area is located. In a third embodiment, the seating area is on the wall structure and the label structure includes the film layer forming a flap platform on which the valve flap is located.

These and other features of the container and/or the label are fully described and particularly pointed out in the claims. The following description and drawings set forth in detail certain illustrative embodiments of the container and/or label which are indicative of but a few of the various ways in which the principles of the invention may be employed.

DRAWINGS

FIG. 1 is a perspective view of a container 10 according to the present invention, the container 10 including a label structure 26 which forms a valving portion of the container 10.

DETAILED DESCRIPTION

Figure 1:
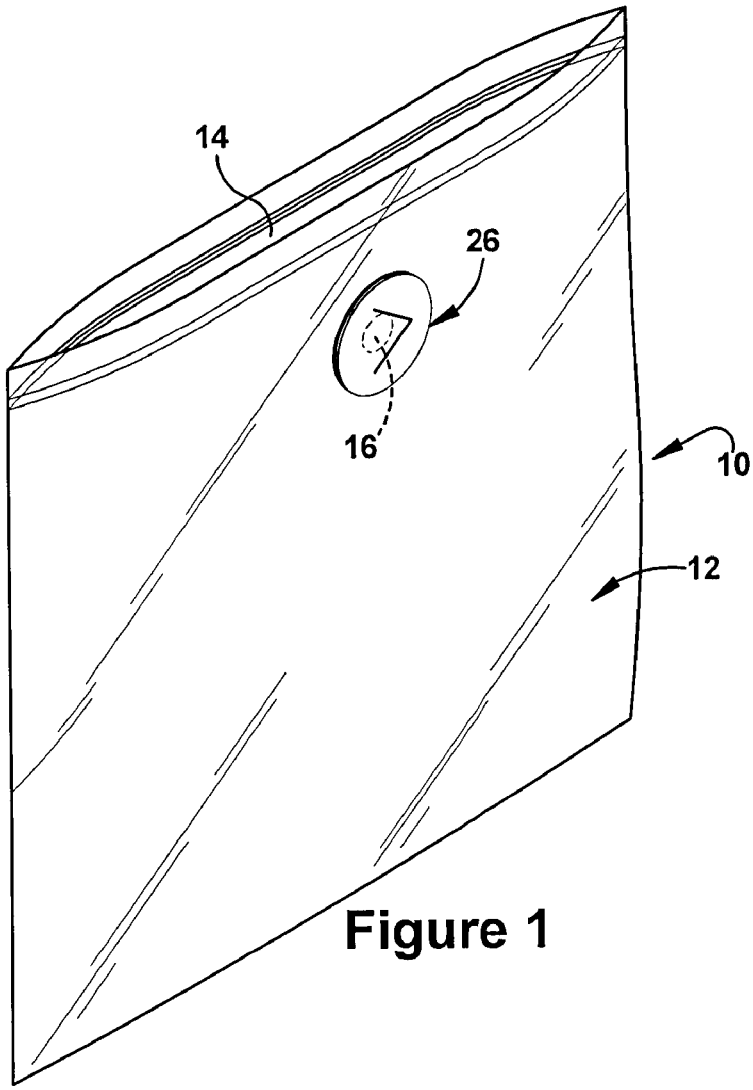

Referring now to the drawings, and initially to FIG. 1, a container 10 according to the present invention is shown. The container 10 comprises a wall structure 12 defining a receptacle 14 for containing a commodity. In the illustrated embodiment, the wall structure 12 has a standard food bag construction comprising flexible plastic panels joined together by side seams, one of which is an openable and closeable seam. However, other wall-structure materials, shapes, sizes, seaming, and/or commodity-holding characteristics are certainly possible with, and contemplated by, the present invention. For example the wall structure 12 can have an industrial bag construction formed from film and/or multi-wall panels.

Figure 2A:
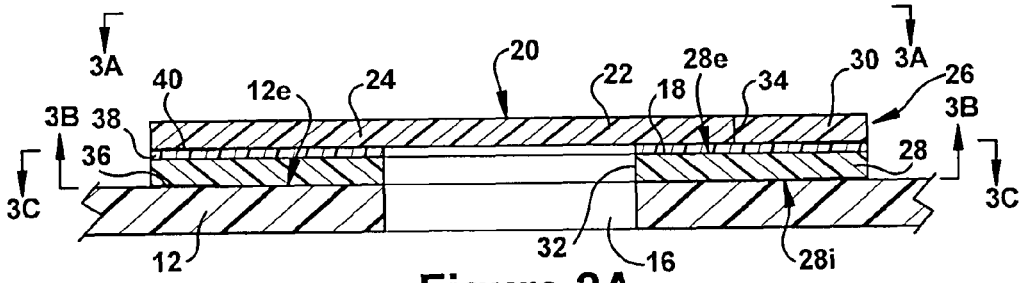
FIGS. 2A and 2B are close-up side views of the valving portion of the container 10, the valving portion being shown with a valve flap in a closed position and an opened position, respectively.
Figure 2B:
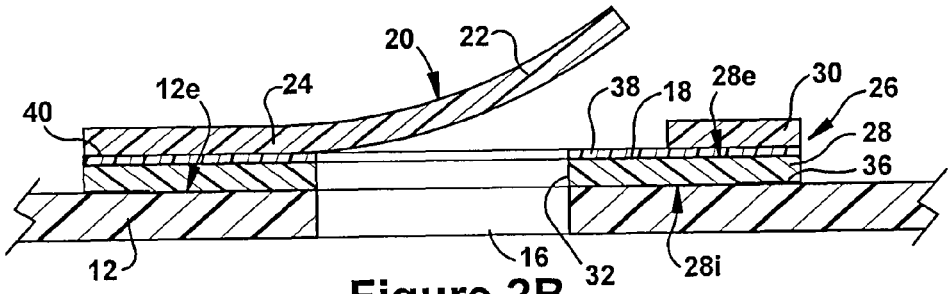

As is best seen by referring additionally to FIGS. 2A and 2B, the container 10 includes an evacuation port 16 in the wall structure 12 through which gas can pass from the receptacle 14 to an outside environment, a seating area 18 adjacent the evacuation port 16, and a valve flap 20. The valve flap 20 includes a movable portion 22 and a hinge portion 24 about which the movable portion 22 pivots. Specifically, the movable portion 22 is movable between a closed position whereat it is seated on the seating area 18 to close the evacuation port 16 (FIG. 2A), and an open position, whereat it is removed from the seating area 18 to open the evacuation port 16 (FIG. 2B).

Figure 3A:
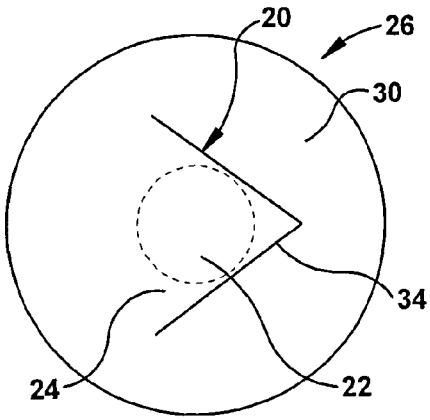
FIGS. 3A and 3B are top and bottom views, respectively, of the label structure 26.
Figure 3B:
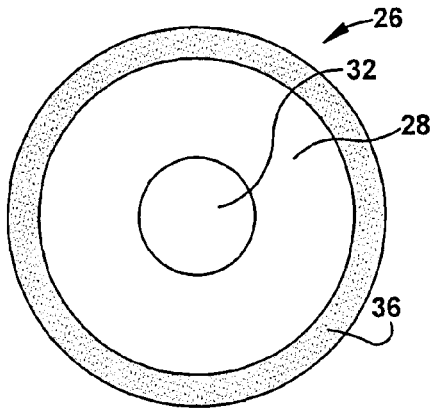

A label structure 26 forms the seating area 18 and the valve flap 20 in the container 10. (FIGS. 1, 2A-2B, and 3A-3C.) The label structure 26 comprises a film layer 28 forming a seat platform on which the seating area 18 is located and a film layer 30 forming a flap platform on which the valve flap 20 is located. (FIGS. 2A-2B and FIGS. 3A-3C.) The film layer 28 includes an opening 32 and the film layer 30 has a cut 34 that defines the valve flap 20. (FIGS. 3A and 3B.)

The label structure 26 additionally comprises a label-to-wall adhesive 36, a seating adhesive 38, and a film-to-film adhesive 40. (FIGS. 2A-2B and FIGS. 3A-3C.) When the label structure 26 is incorporated into the container 10, the label-to-wall adhesive 36 secures the label structure 26 to the exterior surface $\mathbf{12}_e$ of the container's wall structure 12, and the seating adhesive 38 holds the movable portion 22 of the valve flap 20 in the closed position.

Figure 3C:
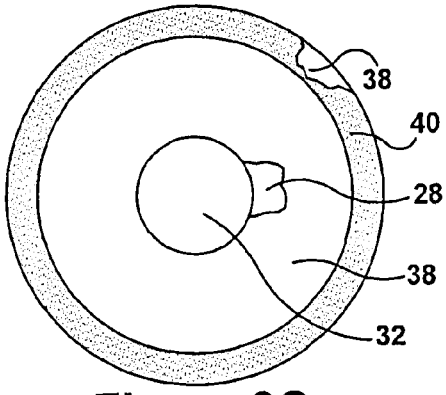
FIG. 3C is a top view of the label structure 26 with a top film layer removed to show the underlying layers.

In the illustrated embodiment, the label-to-wall adhesive 36 is patterned on the interior surface $\mathbf{28}_i$ of the film layer 28 in an annular shape aligned to surround the seating area 18. (FIGS. 2A-2B and FIG. 3B.) The seating adhesive 38 covers the entire exterior surface $\mathbf{28}_e$ of the film layer 28. (FIGS. 2A-2B and FIG. 3C.) The film-to-film adhesive 40 is patterned on the seating adhesive 38 in an annular shape aligned to surround the seating area 18. (FIGS. 2A-2B and FIG. 3C.) The outer perimeter of the seating adhesive 38 and the inner perimeter of the film-to-film adhesive 40 can be generously spaced radially outward from the seating area 18 to eliminate any undesired adhesive-migration into the seating area 18.

Figure 4:
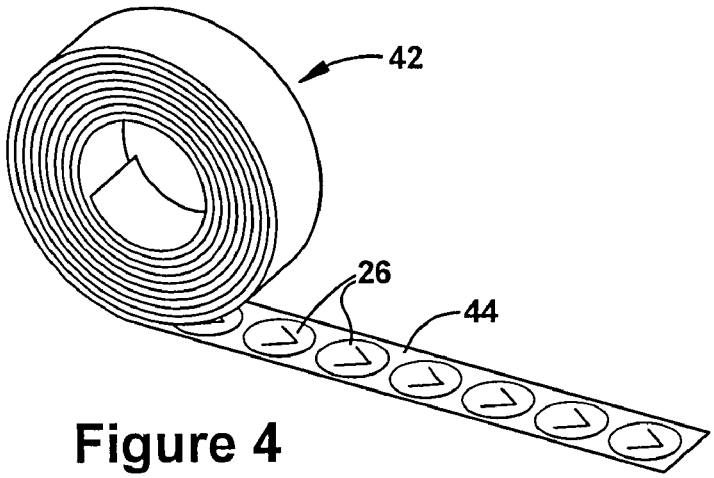
FIG. 4 is a perspective view of a web containing a plurality of the label structures 26.

The label structures 26 can be efficiently and economically mass-produced by a label-manufacturer at a first location and then supplied to the container-manufacturer at a second location for convenient incorporation into the containers 10. For example, as shown in FIG. 4, the label-manufacturer can provide a web 42 comprising a carrier release liner 44 having a plurality of the label structures 26 temporarily attached thereto.

A method of making the web 42 of label structures 26 is shown schematically in FIGS. 5A-5I. It should be noted that in these Figures, the thicknesses of the layers used to create the label structures 26 is greatly exaggerated for ease in illustration and explanation. In actual practice, the film/adhesive layers would much thinner, specifically, for example, in the range of 1 mm or less.

Figure 5A:
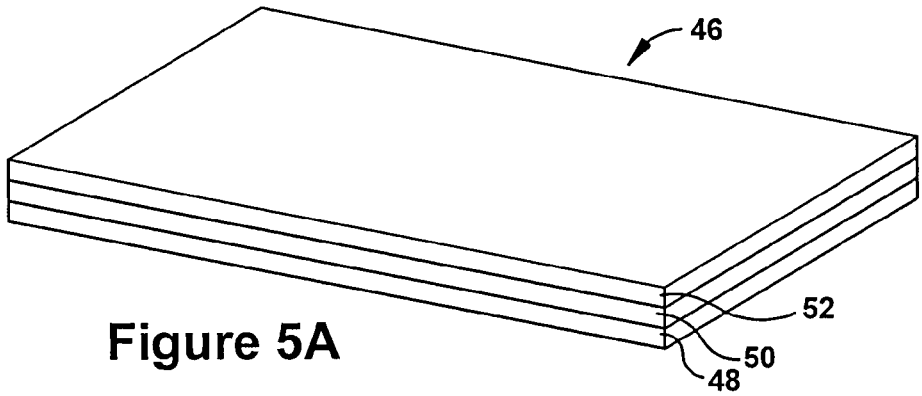
FIGS. 5A-5I are schematic views of a method of making a plurality of the label structures 26.
Figure 5B:
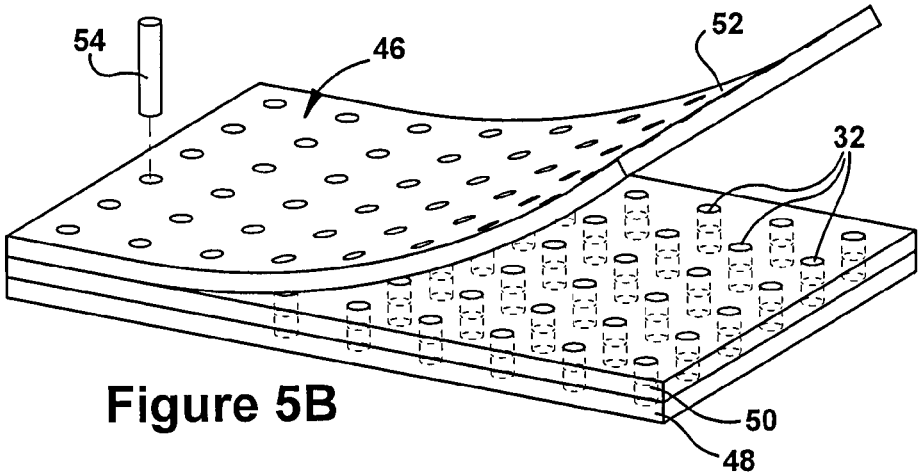

In the illustrated label-making method, a laminate 46 is provided that comprises a film layer 48 (corresponding to the seating platform film layer 28 in the label structure 26), an adhesive layer 50 (corresponding to the seating adhesive layer 38 in the label structure 26), and a release liner 52. (FIG. 5A.) The laminate 46 can be manufactured at another location and supplied to the label-manufacturer in its compiled form. Alternatively, the layers 48/50/52 can be compiled by the label-manufacturer upstream and/or in-line with subsequent label-production steps. In either case, openings 32 are punched through the laminate 46 and thereafter the release liner 52 and the slugs 54 (from the openings 32) are removed. (FIG. 5B.)

Figure 5C:
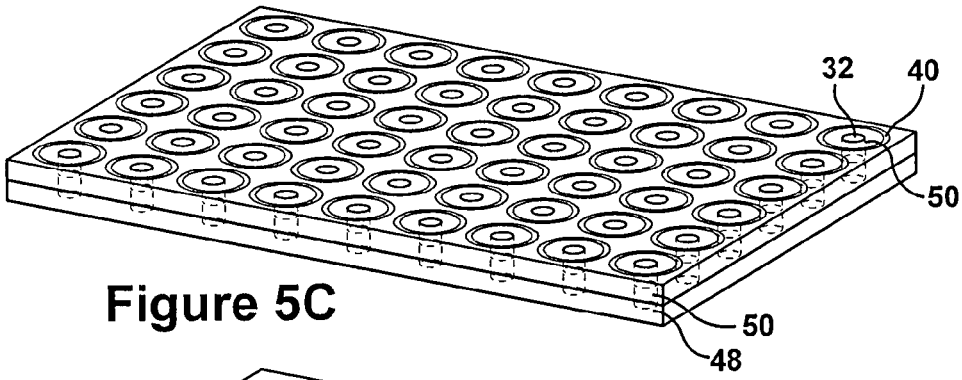
Figure 5D:
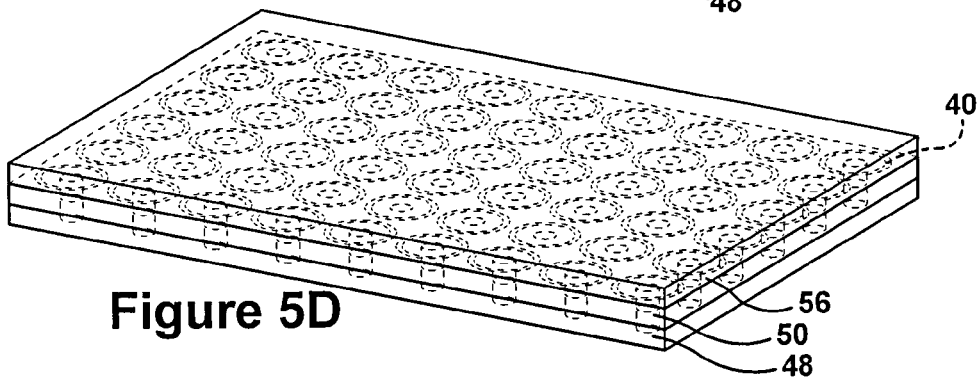
Figure 5E:
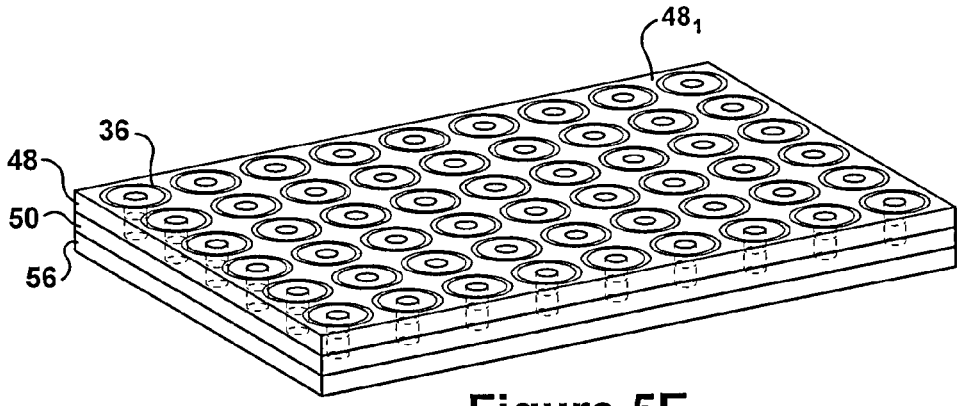

The film-to-film adhesive 40 is then printed in a pattern over the now-exposed adhesive layer 50. (FIG. 5C.) A film layer 56 (corresponding to the film flap layer 30) is placed over the adhesive layer 50 and secured thereto by the printed film-to-film adhesive 40. (FIG. 5D.) The label-to-wall adhesive layers 36 are then printed on the first surface $\mathbf{48}_1$ of the film layer 48. (FIG. 5E.) (A flipping or turning of the compiled layers 48/50 may be necessary prior to this printing step.) It may be noted that the earlier formation of the openings 32 allows these openings to be used for registration purposes when printing the annular adhesive patterns with the label-to-wall 36 and film-to-film 40 adhesives.

Figure 5F:
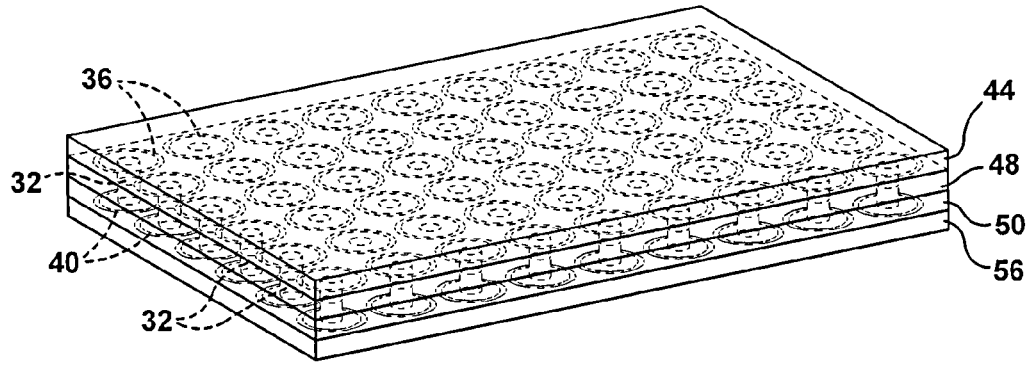
Figure 5G:
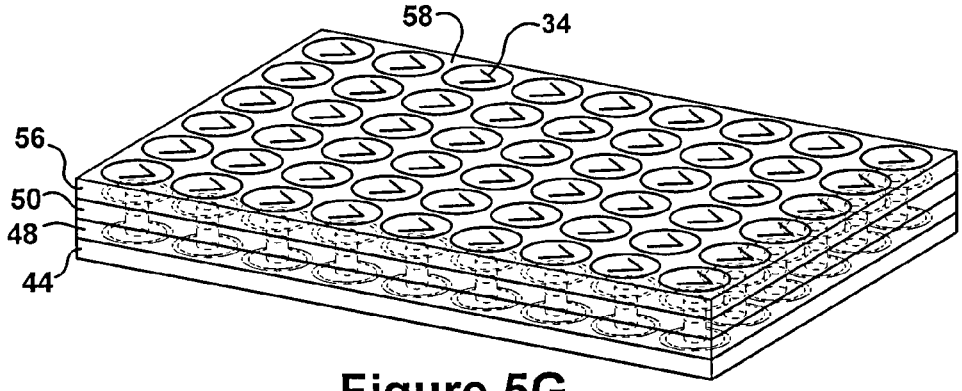

The carrier release liner 44 (i.e., the carrier layer for the web 42) is then placed over the adhesive-printed first surface $\mathbf{48}_1$ of the film layer 48, and temporarily secured thereto by the label-to-wall adhesive printed patterns 36. (FIG. 5F.) Thereafter, the overall label shape (e.g., circular) is die cut through the film layers 48 and 56, but not the carrier release liner 44. (FIG. 5G.) In the illustrated embodiment, the flap-defining cuts 34 are formed in the film layer 56 (but not the film layer 48 and not the carrier release liner 44) during the die-cutting step (FIG. 5G). However, this flap-forming step could instead be performed downstream of the die-cutting step or upstream of the die cutting step (e.g., before the compiling step, before the adhesive-printing step, etc.).

Figure 5H:
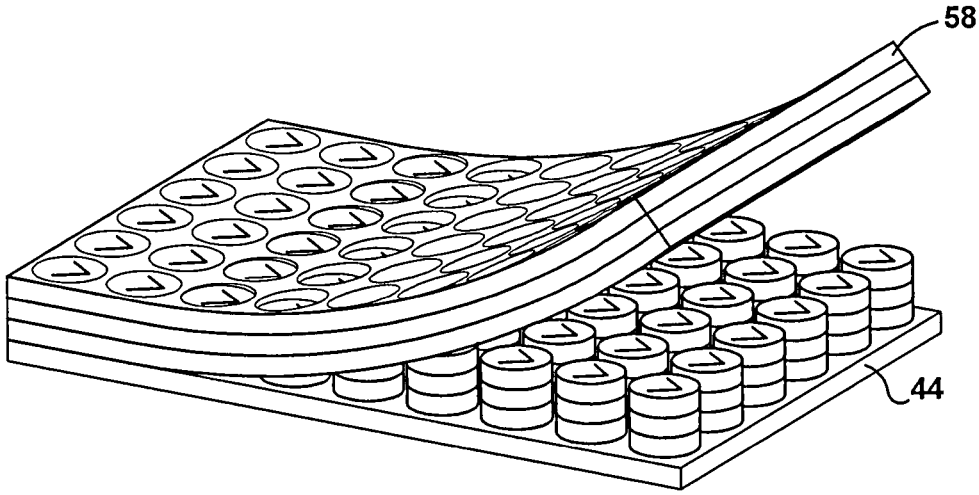
Figure 5I:
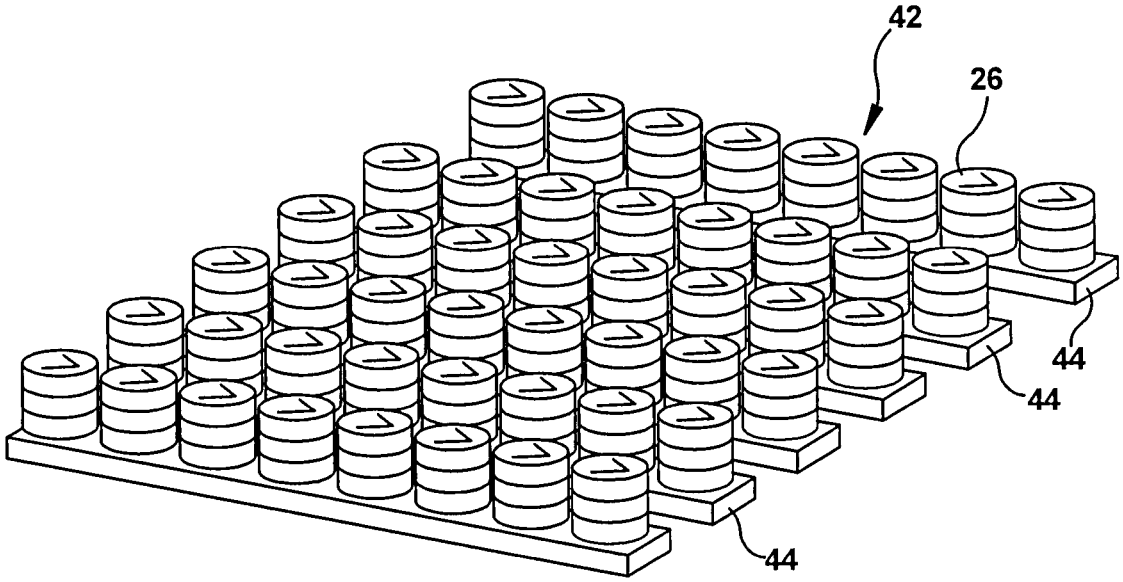

Thereafter, if desired, the surrounding matrix 58 can be removed and/or the product divided into single-row webs 42. (FIGS. 5H and 5I.)

Figure 6A:
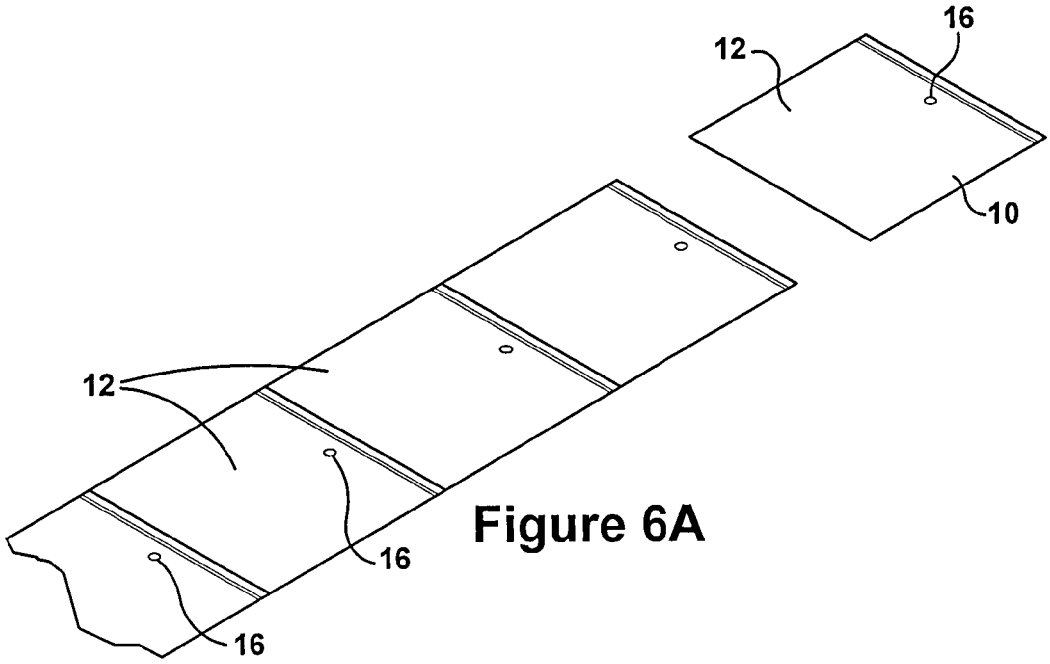
FIGS. 6A and 6B are schematic views of a method of incorporating the label structures 26 into containers 10.
Figure 6B:
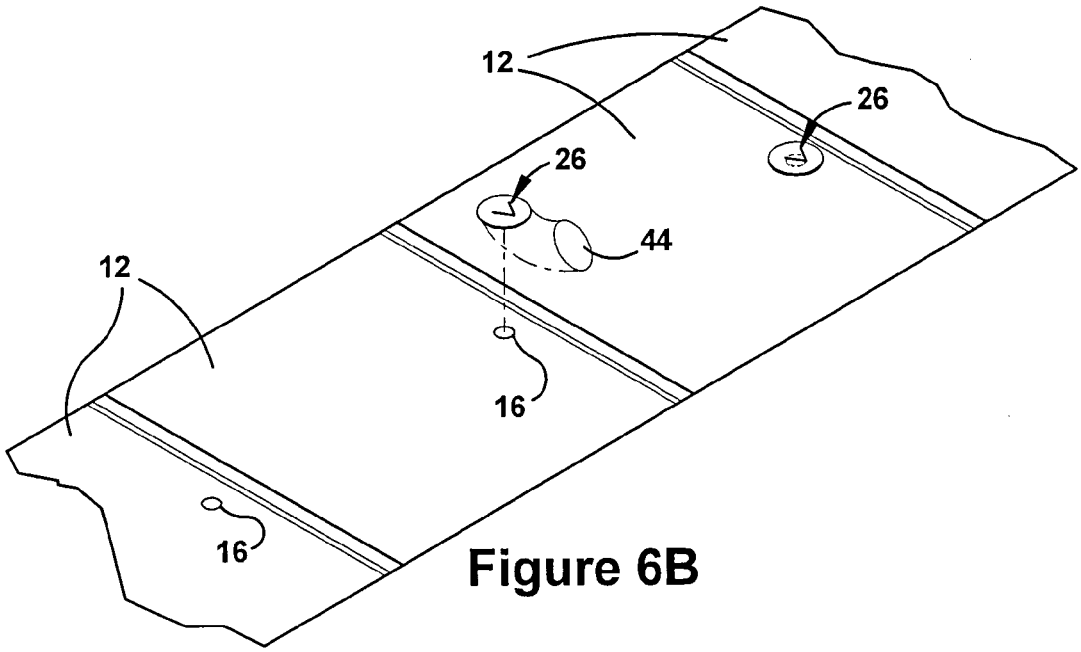

The wall structures 12 of the containers 10 can be separately mass-manufactured in a continuous strip wherein, for example, the bottom seam of one wall structure 12 abuts against the top seam of the adjacent downstream wall structure 12. (FIG. 6A). Before, after, or during creation of the wall structure 12, the evacuation port 16 can be cut or otherwise formed in the wall structure 12. The label structures 26 can be removed from the carrier release liner 44, aligned with the ports 16 and secured to the wall structures 12 (FIG. 6B). The removal, aligning, and securing step can be performed automatically (i.e., by a machine, not shown) or can be performed manually (i.e., by a person, not shown). The wall structures 12 can be separated from each other by a severing device (not shown), either before or after the label-securing step.

Figure 7A:
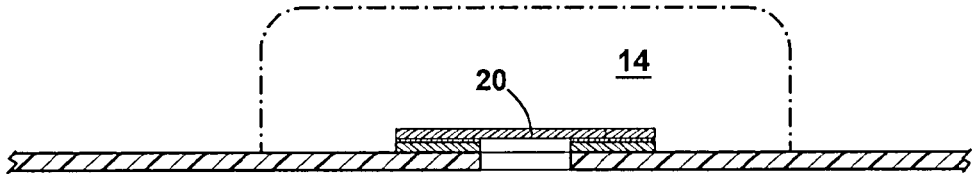
FIGS. 7A-7F are schematic views of various ways of opening/closing the valve flap 20 of the container 10.
Figure 7B:
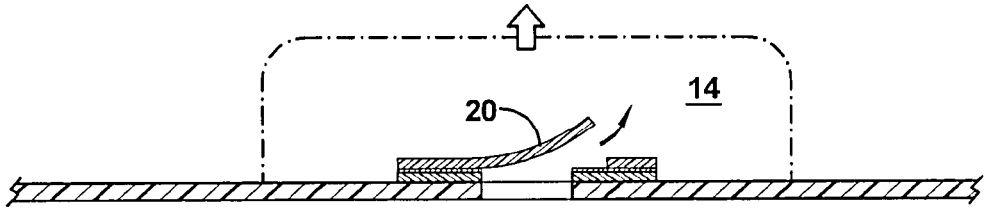
Figure 7C:
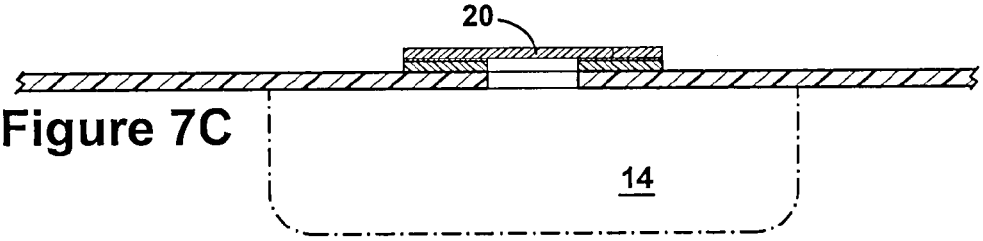
Figure 7D:
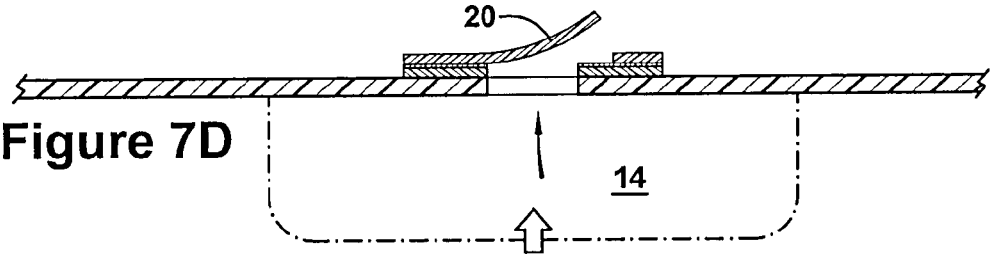

The label structure 26 allows gas to be selectively removed from the receptacle 14 of the container 10 to provide optimum storage conditions for a commodity stored therein. For example, forces outside the receptacle 14 can be used to pull the flap 20 to the opened position (FIGS. 7A and 7B) and/or pressure from inside the receptacle 14 can push the valve flap 20 to the opened position. (FIGS. 7C and 7D.) The pressure from inside the receptacle 14 can be result of the commodity/gas therein expanding to a great volume and/or from the receptacle 14 being compressed to a smaller volume. For example, with an industrial-bag-construction, a weight or flattening device could be applied to the wall structure 12 to cause a rise of pressure within the receptacle 14.

Figure 7E:
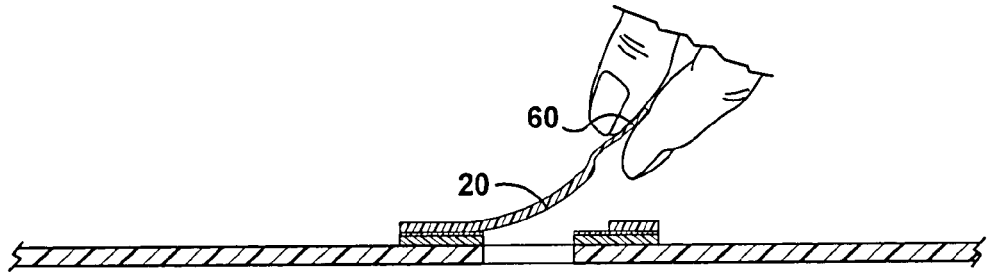

Alternatively, the valve flap 20 can be manually or otherwise placed in the opened position prior to the relevant force being imposed on the receptacle 14. (FIG. 7E.) The valve flap 20 can be designed to have sufficient resiliency to return to the closed position upon removal of the relevant force, or the valve flap 20 can be pushed, manually or otherwise, back to its closed position. (FIG. 7E.) If the valve flap 20 is to be manually placed in the opened position and/or the closed position, it can include a finger tab 60 for easier manipulation. (FIG. 7E.)

Figure 7F:
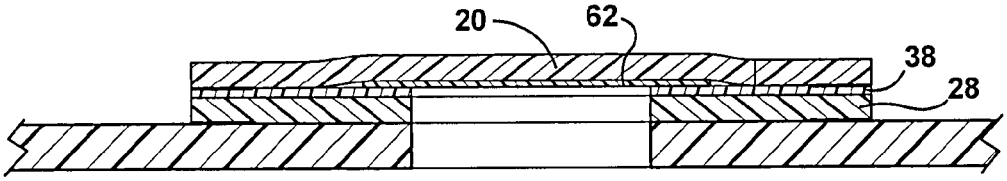

In certain circumstances, it may be desirable for the valve flap 20 to be re-opened after a post-evacuation closure, while in other circumstances, a permanent post-evacuation closure may be preferred. If re-opening of the valve flap 20 is desired, the seating adhesive 38 can be a resealable pressure-sensitive adhesive. If re-opening is not desired, the seating adhesive 38 can be a permanent adhesive, with a release-liner tab 62 temporarily placed over the flap-region of the seating adhesive 38. (FIG. 7F.) Alternatively, permanent closure can be accomplished by the seating adhesive 38 being an energy-activated adhesive (e.g., a heat-activated adhesive) which is activated after evacuation.

Figure 8A:
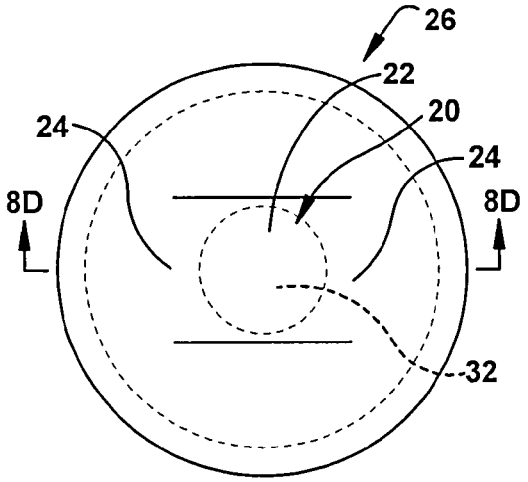
FIGS. 8A-8C are top views of label structures 26 with modified valve flap designs.
Figure 8B:
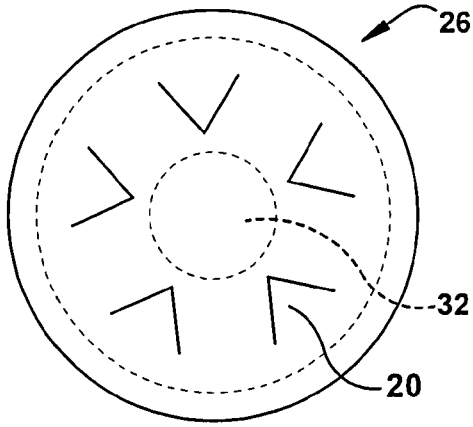
Figure 8C:
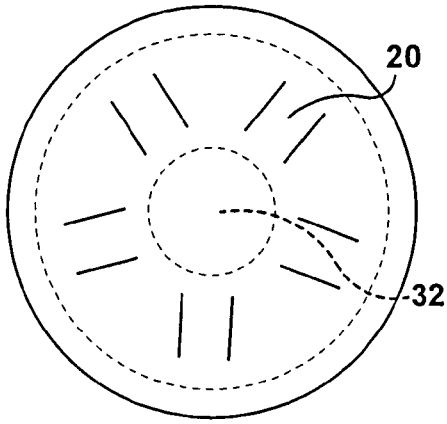
Figure 8D:
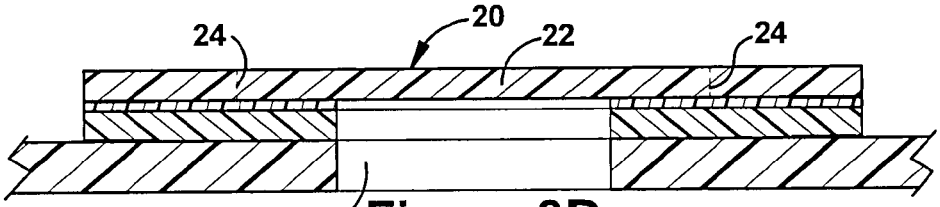
FIGS. 8D and 8E are close-up side views of the label structure 26 of FIG. 8A incorporated into a container 10, the valve flap being shown in a closed position and an opened position, respectively.
Figure 8E:
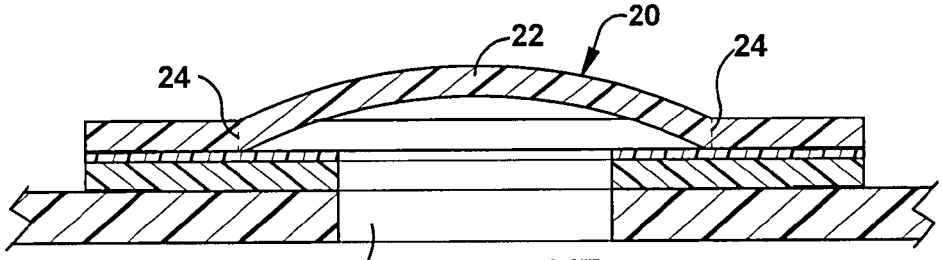

The container 10 can, as shown, have a single valve flap 20 for its seating area 18 and this valve flap 20 can have a single hinge portion 24 connecting its movable portion 22 to the wall structure 12. However, the valve flap 20 can instead comprise two hinge portions 24 on opposite sides of the movable portion 22 as is shown in FIG. 8A. Additionally or alternatively, the container 10 can comprise a plurality of valve flaps 20 for each seating area 18 as shown in FIGS. 8B and 8C. With particular reference to the valve flap design shown in FIGS. 8A and 8C, the hinge portions 24 allow the movable portion 22 of the valve flap 20 to lift away from the rest of the film layer 30 (e.g., "pucker up") to allow gas to exit. (See FIGS. 8D and 8E.) In any event, any combination of movable portion(s) 22 and hinge portion(s) 24 which allow the flap(s) 20 to move between the closed position and the opened position is possible with, and contemplated by, the present invention.

Figure 9A:
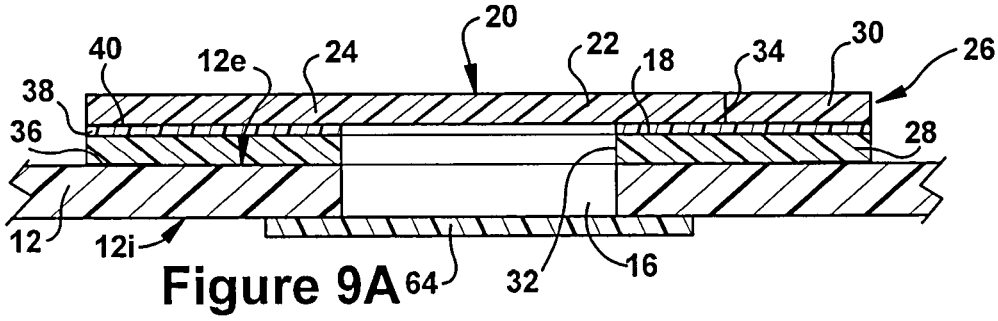
FIGS. 9A-9E are close-up side views similar to FIG. 2A, except that a vent layer has been incorporated into the container 10 and/or the label structure 26.
Figure 9B:
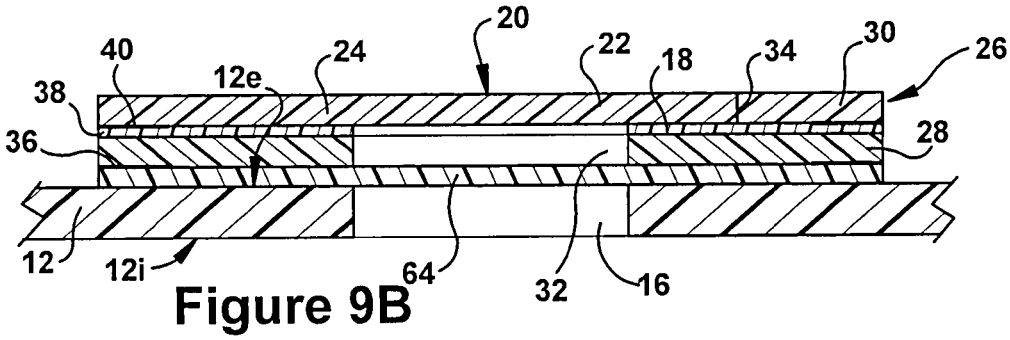
Figure 9C:
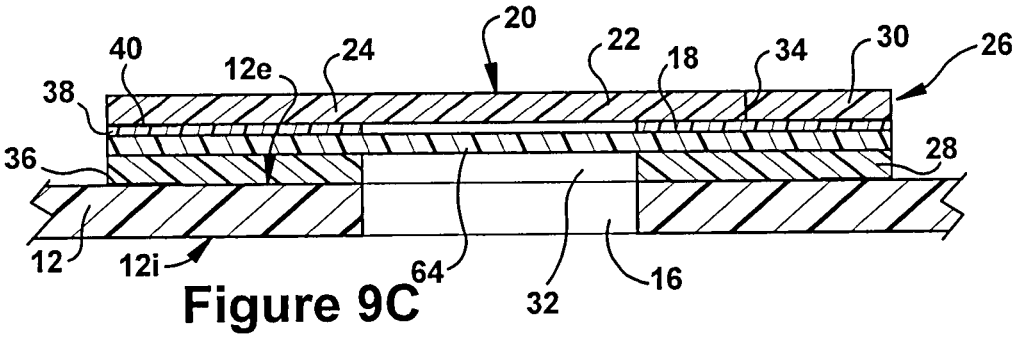
Figure 9D:
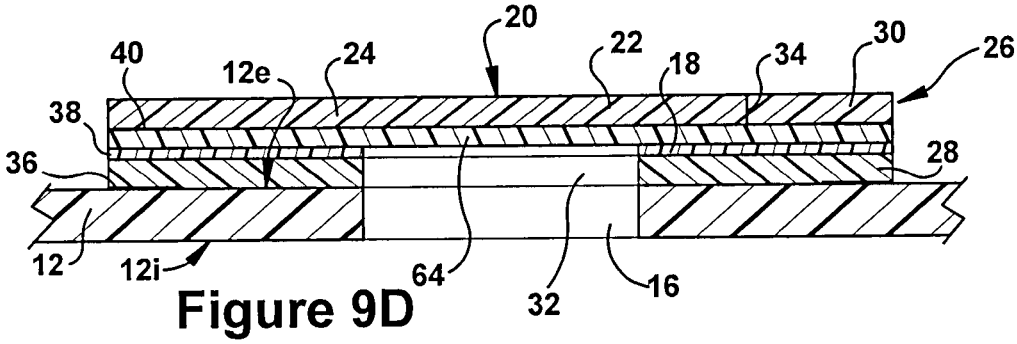
Figure 9E:
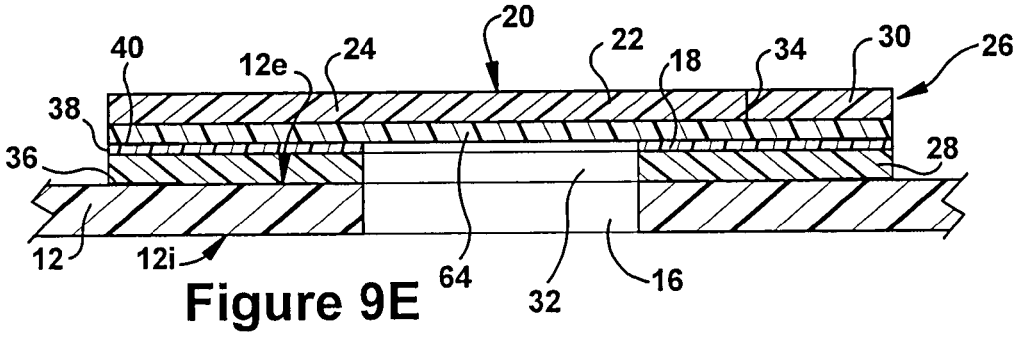

In certain situations, it may be desirable for the valving of the container 10 to prevent liquids (or powders) from exiting the receptacle 14 via the evacuation port 16. If so, it may be desirable to include a vent layer 64 which is pervious with respect to the expected gasses while, at the same time, it is substantially impervious to the expected liquids (or powders). The vent layer 64 can be positioned on the interior surface $\mathbf{12}_i$ of the wall structure 12 (FIG. 9A), on the exterior surface $\mathbf{12}_e$ of the wall structure 12 (FIG. 9B), and/or between the film layer 28 and the seating adhesive 38 (FIG. 9C).

Figure 10A:
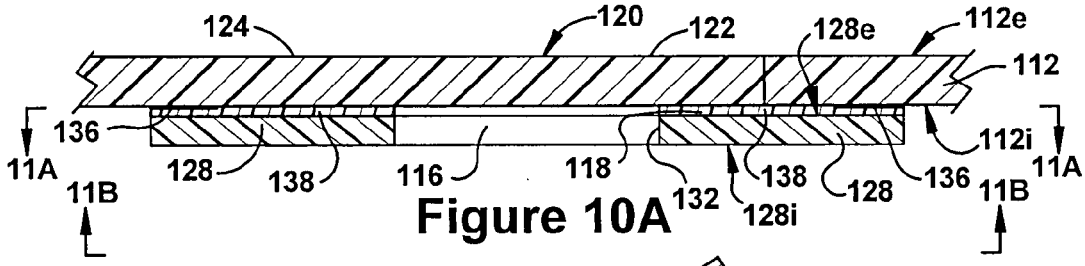
FIGS. 10A and 10B are close-up side views of the valving portion of a container 110, the valving portion being shown with a valve flap in a closed position and an opened position, respectively.
Figure 10B:
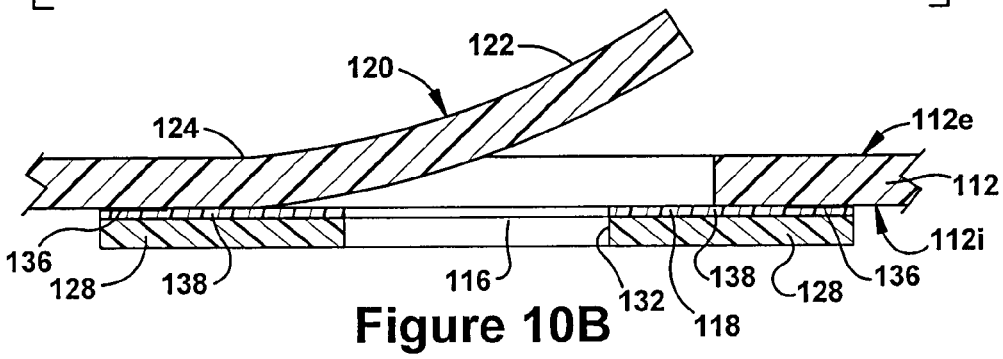

Referring now to FIGS. 10A and 10B, another container 110 according to the present invention includes an evacuation port 116 in its wall structure 112, a seating area 118 adjacent to the evacuation port 116, and a valve flap 120. The valve flap 120 includes a movable portion 122 and a hinge portion 124 about which the movable portion 122 pivots. The valve flap 120 is formed (e.g., cut) in the wall structure 112 and the evacuation port 116 is the opening defined by the flap 120.

Figure 11A:
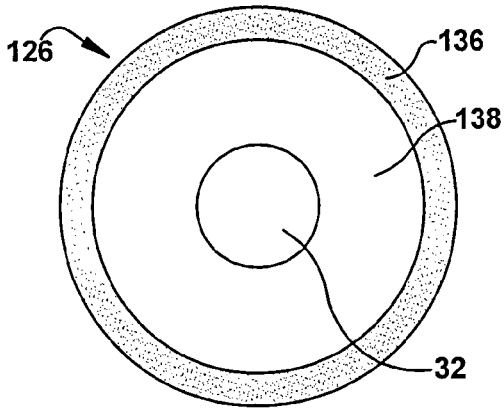
FIGS. 11A and 11B are top and bottom views, respectively, of a label structure 126 which forms a valving portion of the container 110.
Figure 11B:
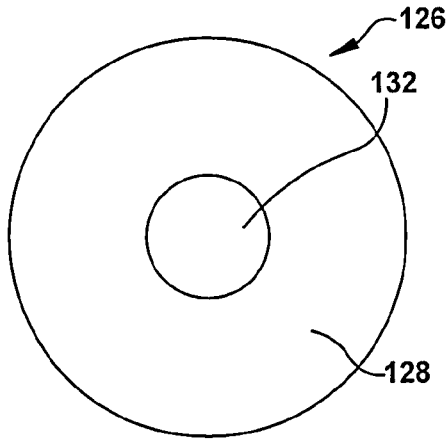

As is best seen by referring additionally to FIGS. 11A-11B, a label structure 126 forms the seating area 118. The label structure 126 comprises a film layer 128, forming a seat platform on which the seating area 118 is located, a label-to-wall adhesive layer 136 and a seating adhesive layer 138. When the label structure 126 is incorporated into the container 110, the label-to-wall adhesive layer 136 secures the label structure 126 to the interior surface $\mathbf{112}_i$ of the container's wall structure 112 and the seating adhesive 138 holds the movable portion 122 of the valve flap 120 in the closed position. In the illustrated embodiment, the seating adhesive layer 138 covers the exterior surface $\mathbf{128}_e$ of the film layer 128 and the label-to-wall adhesive layer 136 is patterned on the adhesive layer 138 in annular shape that is aligned to surround the seating area 118. Preferably, the inner perimeter of the label-to-wall adhesive layer 136 is generously spaced radially outward from the seating area 118 to avoid adhesive migration issues.

Figure 12:
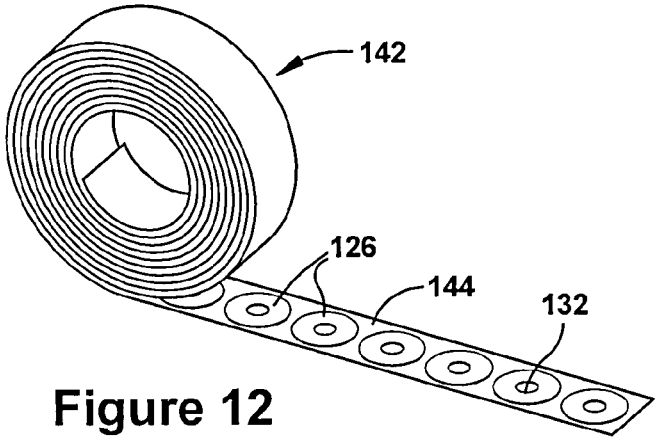
FIG. 12 is a perspective view of a web containing a plurality of the label structures 126.
Figure 13A:
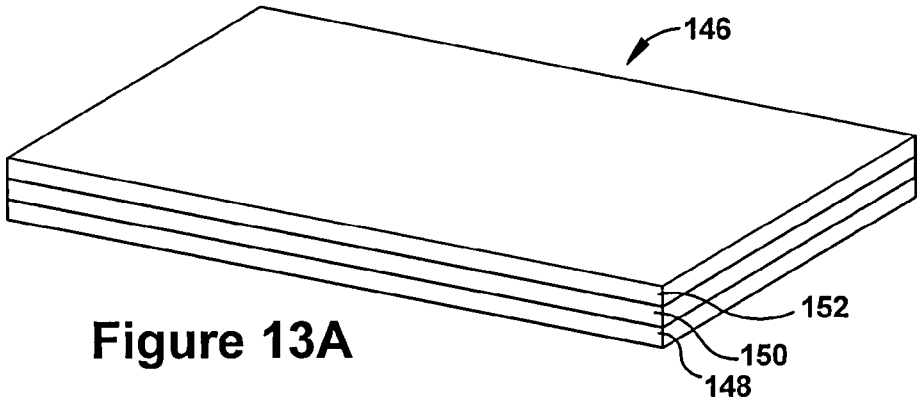
FIGS. 13A-13G are schematic views of a method of making a plurality of the label structures 126.
Figure 13B:
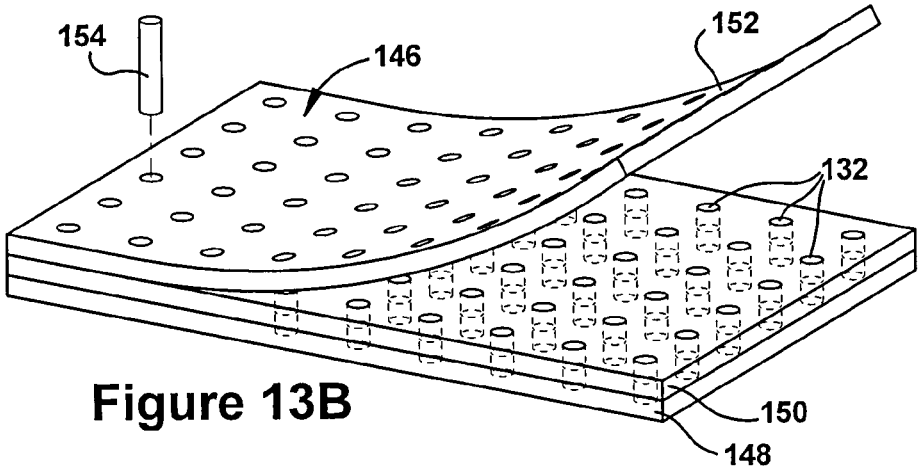
Figure 13C:
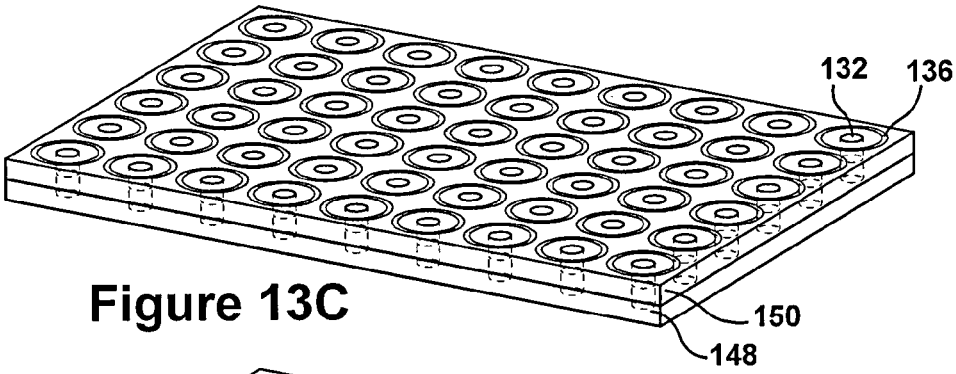
Figure 13D:
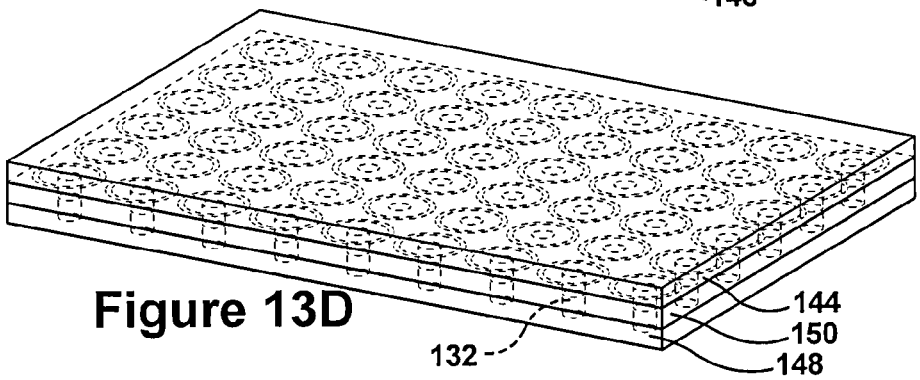
Figure 13E:
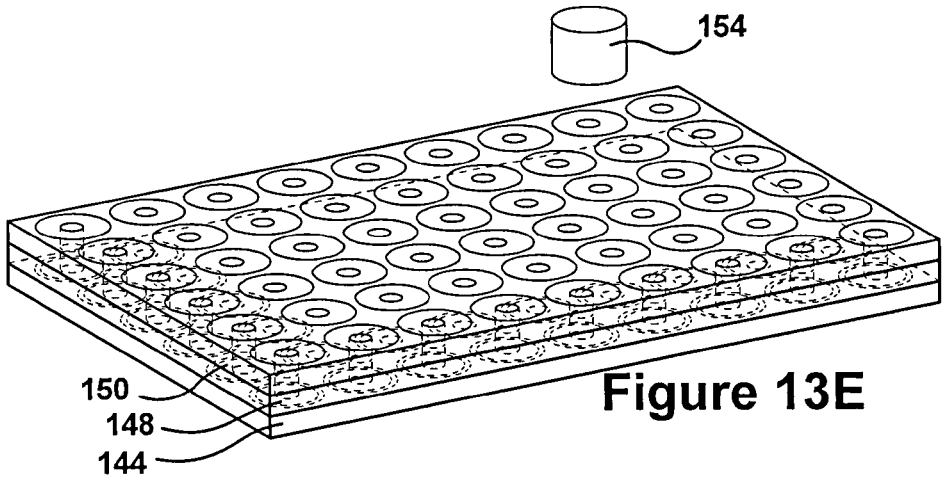
Figure 13F:
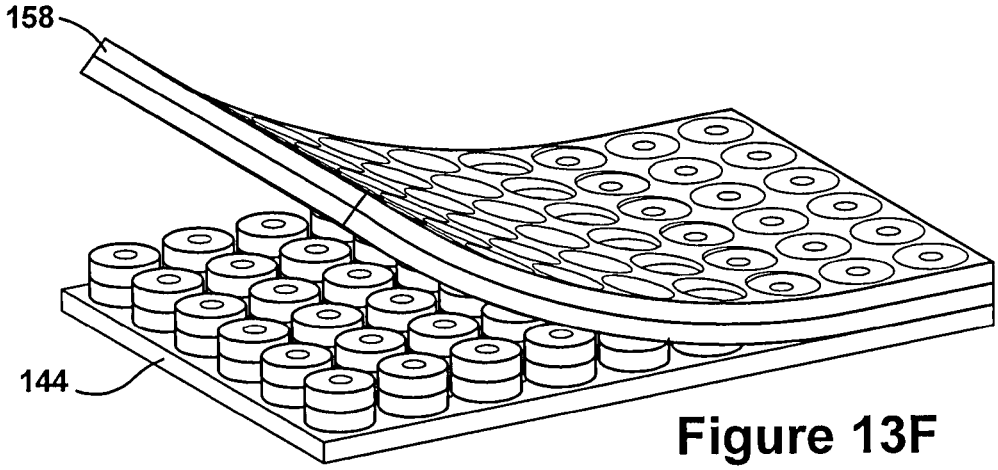
Figure 13G:
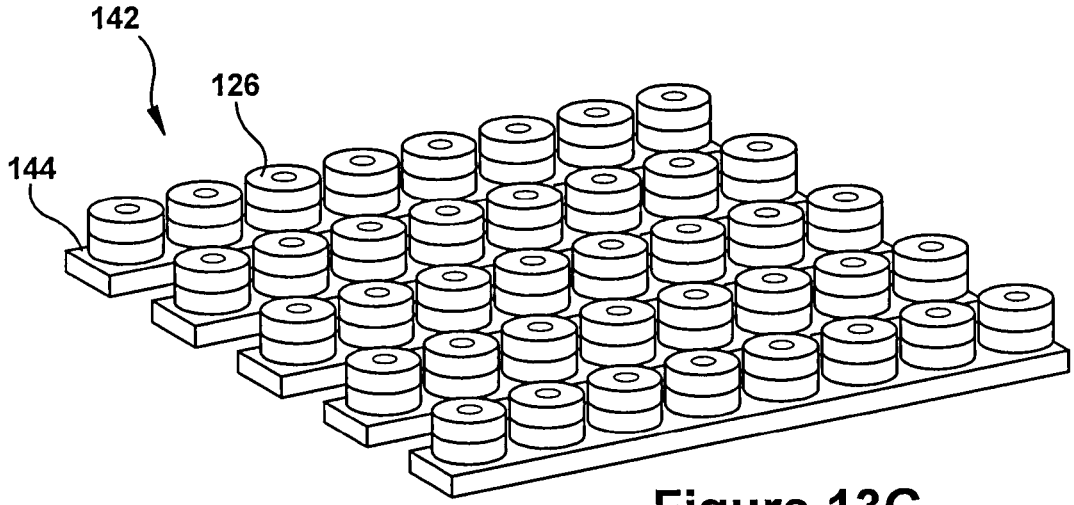

The label-manufacturer can provide a web 142 comprising a plurality of label structures 126 temporarily attached to a carrier release liner 144. (See FIG. 12.) The web 142 can be made by first providing a laminate 146 comprising a film layer 148 (corresponding to the seating platform layer 128 in the structure 126), an adhesive layer 150 (corresponding to the seating adhesive layer 138 in the structure 126), and a release liner 152. (FIG. 13A.) The openings 132 are punched through the laminate 146 and thereafter the release liner 152 and the slugs 154 are removed. (FIG. 13B.) The label-to-wall adhesive layer 136 is then printed in an annular pattern over the now-exposed adhesive layer 150. (FIG. 13C). The release liner 144 (i.e., the carrier layer for the web 142) is then placed over the adhesive-printed surface 148, of the film layer 148, and temporarily secured thereto by the label-to-wall adhesive printed patterns 136. (FIG. 13D.) Thereafter, the overall label shape (e.g., circular) is then die cut through the film layer 148 (but not the carrier release liner 144). (FIG. 13E.) Thereafter the surrounding matrix 158 can be removed and/or the sheet divided into single-row webs 142. (FIGS. 13F and 13G.) (Again, the thicknesses of the film and adhesive layers are greatly exaggerated for the ease in illustration and explanation.)

The wall structures 112 of the containers 110 can be separately mass-manufactured and the label structures 126 can be removed from the carrier release liner 144, aligned with the ports 116 and secured to the wall structures 112. (See FIGS. 6A and 6B, above.) In this embodiment of the invention, however, the label structures 126 are secured on the inside of the container 110, whereby it may be more advantageous to secure the label structures 126 to the evacuation ports 116 during an intermediate stage of the manufacture of the containers 110. For example, the label structures 126 could be secured while the wall-structure material is still in sheet form and/or the seams have not yet been sealed.

As with the container 10, a force outside the container 110 can pull the flap 120 open, a pressure force from within the container 110 can push the flap 120 open, the valve flap 120 can be manually opened/closed. The seating adhesive 138 can be a resealable pressure-sensitive adhesive, a permanent pressure-sensitive adhesive, or a heat-activated adhesive. (See FIGS. 7A-7F, above.) The container 110 can have a single valve flap 120, a plurality of valve flaps 120, a single-hinge flap design and/or a double-hinge flap design. (See FIGS. 8A-8C, above.) The container 110 and/or the label structure 126 can include a vent layer 64 positioned, for example, on the exterior surface $\mathbf{112}_e$ of the wall structure 112 and/or between the film layer 128 and the seating adhesive 138. (See FIGS. 9A-9C.)

Figure 14A:
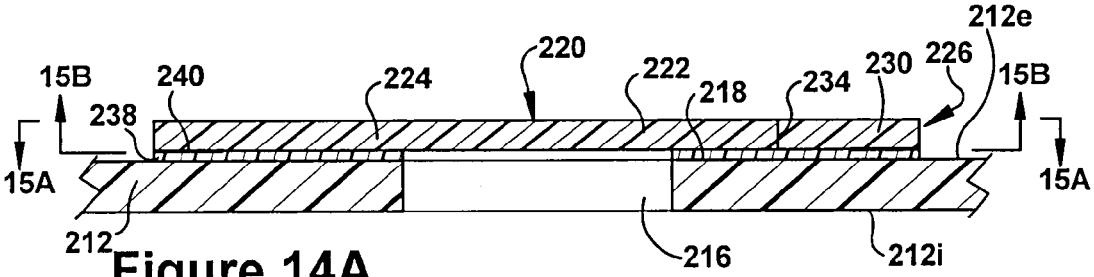
FIGS. 14A and 14B are close-up side views of the valving portion of a container 210, the valving portion being shown with a valve flap in a closed position and an opened position, respectively.
Figure 14B:
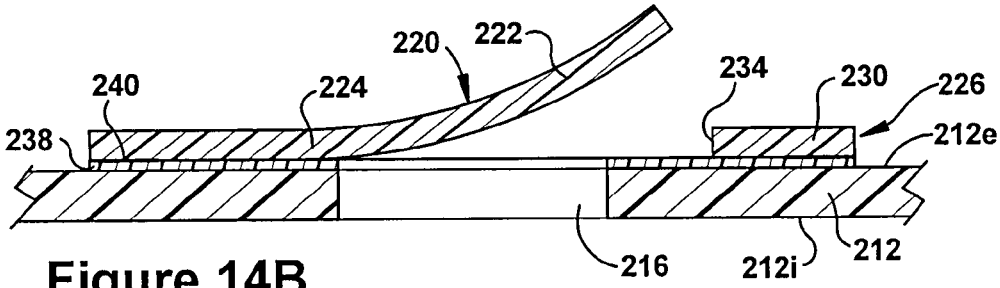

Referring now to FIGS. 14A and 14B, another container 210 according to the present invention includes an evacuation port 216 in its wall structure 212, a seating area 218 adjacent the evacuation port 216, and a valve flap 220. The valve flap 220 includes a movable portion 222 and a hinge portion 224 about which the movable portion 222 pivots. In this embodiment of the invention, the seating area 218 is a region of the wall structure 212 surrounding the evacuation port 216 and the seating adhesive 238 is printed thereupon.

Figure 15A:
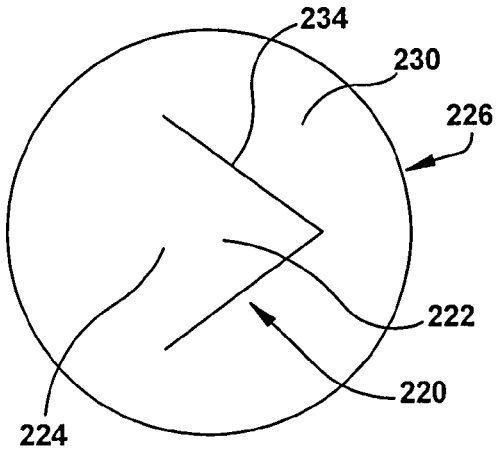
FIGS. 15A and 15B are top and bottom views, respectively, of a label structure 226 which forms a valving portion of the container 210.
Figure 15B:
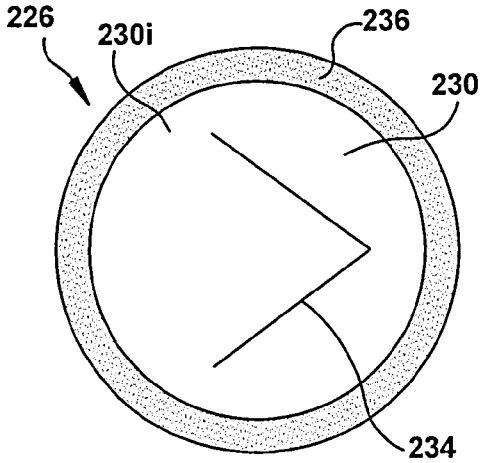

As is best seen by referring additionally to FIGS. 15A and 15B, a label structure 226 forms the valve flap 220. Specifically, the label structure 226 comprises a film layer 230 forming a flap platform on which the valve flap 220 is located (e.g., formed by flap-defining cut 234). The label structure 226 additionally comprises a label-to-wall adhesive layer 236 which, when the label structure 226 is incorporated into the container 210, secures the label structure 226 to the exterior surface $\mathbf{212}_e$ of the wall structure 212. The label-to-wall adhesive layer 236 is patterned on interior surface 230$_i$ of the film layer 230 in an annular shape aligned to surround the seating area 218. Again, the inner perimeter of the label-to-wall adhesive layer 236 is preferably generously spaced radially outward from the seating area 218 to avoid adhesive migration issues.

Figure 16:
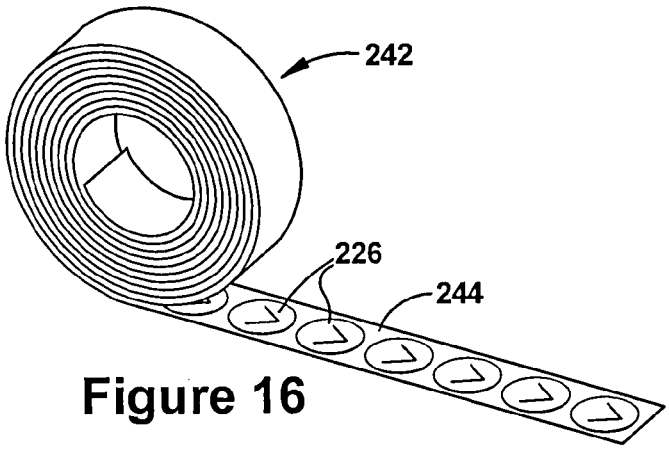
FIG. 16 is a perspective view of a web containing a plurality of the label structures 226.
Figure 17A:
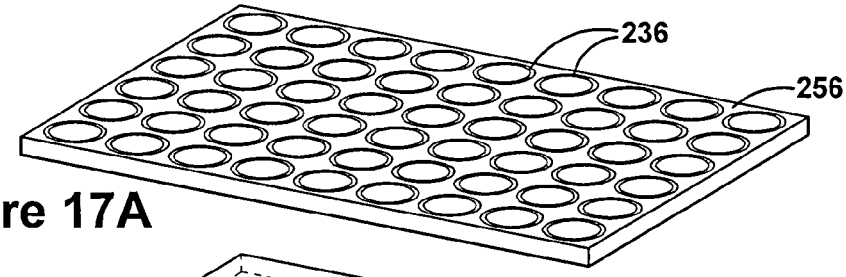
FIGS. 17A-17E are schematic views of a method of making a plurality of the label structures 226.
Figure 17B:
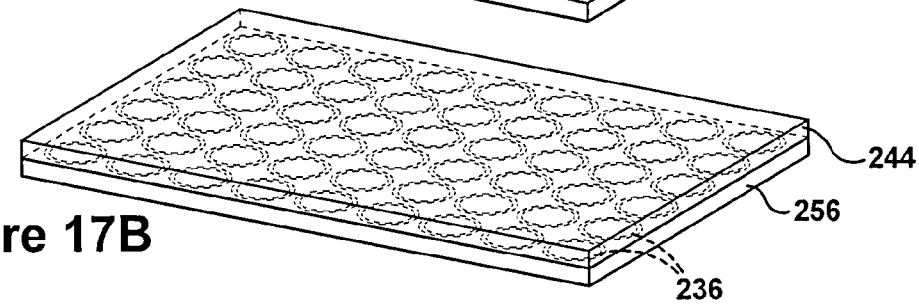
Figure 17C:
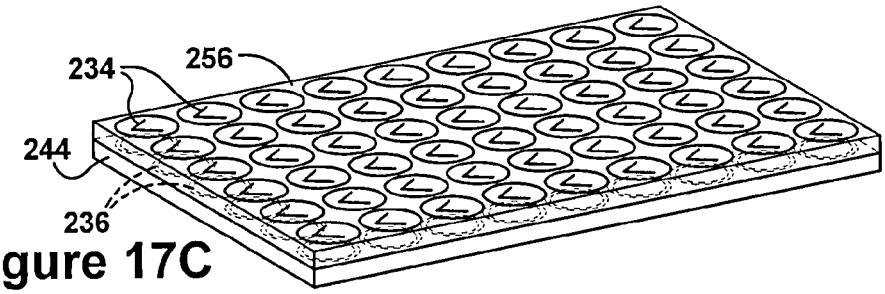
Figure 17D:
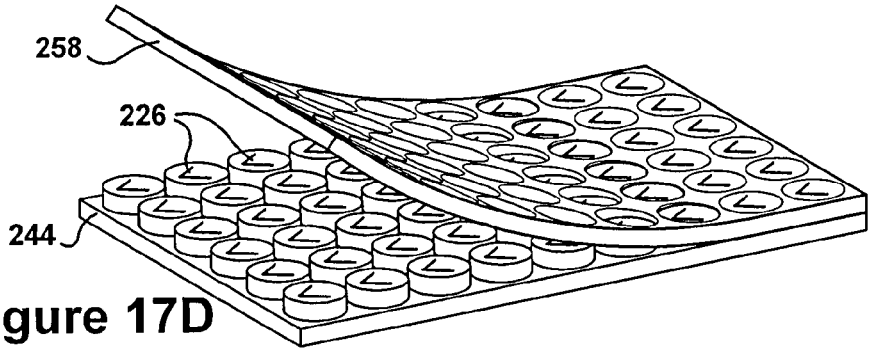
Figure 17E:
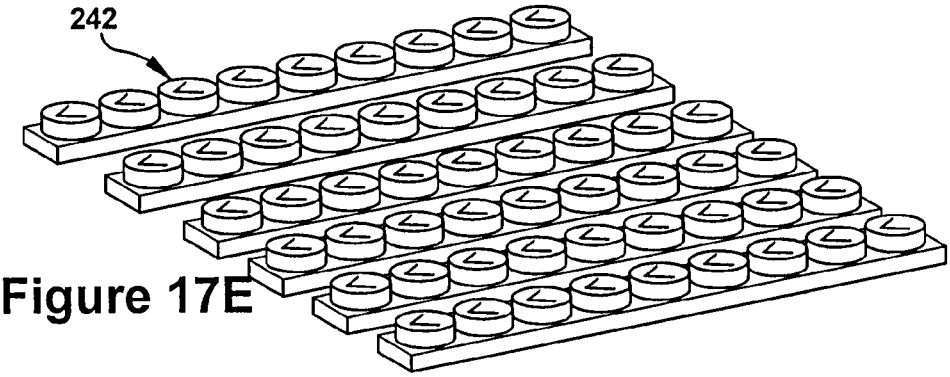

The label-manufacturer can provide a web 242 comprising a plurality of label structures 226 temporarily attached to a release liner 244. (See FIG. 16.) The web 242 can be made by first providing a film layer 256 (corresponding to the flap platform 230) and printing the label-to-wall adhesive 236 thereon. (FIG. 17A.) The release liner 244 (e.g., the carrier layer for the web 242) is then placed over the printed surface of the film layer 256 and temporarily secured thereto by the label-to-wall adhesive layer 236. (FIG. 17B.) Thereafter, the overall shape of the label structures 226 (e.g., round) is die cut through the film layer 256 (but not the release liner 244) and the flap-defining cuts 234 are also formed therein. (FIG. 17C.) The surrounding matrix 258 can be removed and/or the sheet divided into single-row webs 242. (FIGS. 17D and 17E.) (Again, the thicknesses of the film and adhesive layers are greatly exaggerated for the ease in illustration and explanation.)

The wall structures 212 of the containers 210 can be separately mass-manufactured and the label structures 226 can be removed from the release liner 244, aligned with the evacuation ports 216 and secured to the wall structures 212. (See FIGS. 6A and 6B, above.) In this embodiment of the invention, the container-manufacturer would need to apply the seating adhesive 238 to the wall structure 212 at some point in the production process prior to the incorporation of the label structures 226.

As with the container 10 and the container 110, a force outside the container 210 can pull the flap 220 open, a pressure force from within the container 210 can push the flap 220 open, the valve flap 220 can be manually opened/closed. (See FIGS. 7A-7E.) The seating adhesive 238 can be a resealable pressure-sensitive adhesive, a permanent pressure-sensitive adhesive, or a heat-activated adhesive. The container 210 can have a single valve flap 220, a plurality of valve flaps 220, a single-hinge flap design and/or a double-hinge flap design. (See FIGS. 8A-8C.) The container 210 and/or the label structure 226 can include a vent layer 64 positioned, for example, on the interior surface 212$_i$ of the wall structure 212. (See FIG. 9A.)

As was alluded to above, the container wall structures 12/112/212 can be thermoplastic material or a blend of thermoplastic materials. For example, the wall structures 12/112/212 could comprise polyolefins such as high density polyethylene (HDPE), low density polyethylene (LDPE), linear low density polyethylene (LLDPE), and polypropylene (PP); thermoplastic elastomers such as styrenic block copolymers, polyolefin blends, elastomeric alloys, thermoplastic polyurethanes, thermoplastic copolyesters and thermoplastic polyamides; polymers and copolymers of polyvinyl chloride (PVC); polyvinylidene chloride (PVDC); saran polymers; ethylene/vinyl acetate copolymers; cellulose acetates; polyethylene terephthalate (PET); ionomer (Surlyn); polystyrene; polycarbonates; styrene acrylonitrile; aromatic polyesters; linear polyesters; and thermoplastic polyvinyl alcohols. The wall structures 12/112/212 could instead comprise non-thermoplastic, non-plastic materials, and/or any other materials which allow for selective evacuation of gas within the receptacle 14/114/214.

The film layer 28/128 (and thus also the film layers 48/148) and the film layer 30/230 (and thus also the film layers 56/256) can be made from polymer film materials such as polystyrenes, polyolefins, polyamides, polyesters, polycarbonates, polyvinyl alcohol, poly(ethylene vinyl alcohol), polyurethanes, polyacrylates including copolymers of olefins such as ethylene and propylene with acrylic acids and esters, copolymers of olefins and vinyl acetate, ionomers and mixtures thereof. With particular reference to the film layer 30/230 (and film flap layers 56/256), the material must be such that the valve flap 20/120/220 is capable of moving between the closed position and the open position in the intended manner. The finger tab 60 can be made of the same, similar and/or other material.

The label-to-wall adhesive 36/136/236 can be any suitable adhesive, such as a pressure-sensitive adhesive (e.g., acrylic-based, rubber-based, or silicone-based) and, more particularly, a hot melt pressure-sensitive adhesive.

As was indicated above, the seating adhesive 38/138/238 (and thus also adhesive layers 50/150) can be resealable adhesive, a permanent pressure-sensitive adhesive, and/or an energy-activated permanent adhesive. A suitable resealable adhesive would have some tack but could be opened/closed repeatedly, preferably without leaving residue. For example, candidates for the resealable adhesive would include acrylic, silicone and/or rubber-based pressure-sensitive adhesives. Suitable permanent adhesives could also comprise acrylic, silicone and/or rubber-based pressure-sensitive adhesives, the difference being that the bond strength would be much higher than with a resealable adhesive. Suitable energy-activated permanent adhesives could include, for example, heat-activated adhesives, such as those with an adhesive-forming resin (e.g., urethane resin, polyether resin, acrylic resin, oxyalkylene resin, and/or vinyl resin).

The film-to-film adhesive 40 can be any suitable adhesive, such as a pressure-sensitive adhesive (e.g., acrylic-based, rubber-based, or silicone-based) or a curable-adhesive, such as a UV-curable adhesive. It may be noted that if a UV-curable adhesive is used for the adhesive 40, the film layer 30/56 may need to be transparent.

The release and/or carrier liners 44/144/244 and/or 52/152 can be a sheet of paper or polymeric film having a release coating, such as a silicone release coating. The release liner tab 62 can be made of a similar material.

The vent layer 64 can be made from nylon, polyolefins (e.g., polyethylene, polypropylene, ethylene butylene copolymers), polyurethanes, polyurethane foams, polystyrenes, plasticized polyvinylchlorides, polyesters, polyamides, cotton, or rayon. The vent material can be woven, non-woven, knitted and/or an aperatured (or perforated) film. The material used to fabricate the vent layer 64 should have a porosity or perviousness to accomplish the desired evacuation, for example, at least about 5 cfm (cubic feet per minute), at least about 10 cfm, at least about 15 cfm, at least about 20 cfm and/or at least about 25 cfm with respect to air so that an acceptable level of gas flow can be obtained.

It may be noted that another consideration for material selection with respect to the film layers and/or adhesives may stem from the potential food-related use of the container 10. Specifically, the FDA may dictate that only certain materials and/or adhesives can be used when the possibility of food contact exists. Furthermore, if the container 10 is intended to be used as a freezer bag, the materials should be able to remain intact at the expected freezing temperatures. Likewise, if the container 10 is intended to be heated in, for instance, a microwave, the materials should be able to withstand such thermal conditions. Also, with particular reference to the label-to-wall adhesive layers 36/136/236, an important consideration might be whether the label structures 26/126/226 will be automatically or manually attached to the wall structures 12/112/212.

Although the container and/or label structures have been shown and described with respect to certain preferred embodiments, it is obvious that equivalent and obvious alterations and modifications will occur to others skilled in the art upon the reading and understanding of this specification. The present invention includes all such alterations and modifications and is limited only by the scope of the following claims.

The invention claimed is:

1. A container comprising:

a wall structure defining a receptacle;

an evacuation port in the wall structure through which gas can pass from the receptacle to an outside environment;

a seating area adjacent the evacuation port;

a valve flap having a movable portion and a hinge portion about which the movable portion pivots, the movable portion pivots between a closed position and open position about the hinge portion whereat the valve flap is seated on the seating area to close the evacuation port and in the opened position whereat the valve flap lifts away from the seating area to open the evacuation port; and a seating adhesive on the seating area which holds a movable portion of the valve flap in the closed position and covers an exterior surface of a film layer and the seating adhesive has an annular shape wherein the adhesive is a permanent adhesive and holds the movable portion of the valve flap in the closed position and prevents reopening of the valve flap:

wherein a label structure attached to the wall structure includes the film layer forming a seat platform on which the seating area is located wherein the film layer forming the seat platform includes an outer perimeter and an opening aligned with the evacuation port, and wherein the seating adhesive extends from the outer perimeter of the film layer to the opening of the film layer.

2. A container as set forth in claim 1, wherein the label structure further includes a film layer forming a flap platform on which the valve flap is located.

3. A container as set forth in claim 2, wherein the film layer forming the flap platform includes a cut that defines the valve flap.

4. A container as set forth in claim 1, wherein the label structure further comprises:

a label-to-wall adhesive that secures the label structure to the exterior surface of the wall structure;

a film-to-film adhesive patterned on the seating adhesive that secures the film layer to the valve flap.

5. A container as set forth in claim 1, wherein the label structure includes the film layer forming a seat platform on which the seating area is located.

6. A container as set forth in claim 1, wherein the label structure further comprises a label-to-wall adhesive that secures the label structure to the interior surface of the wall structure and the seating adhesive.

7. A container as set forth in claim 1, wherein the seating adhesive is a heat activated adhesive which can be activated to prevent re-opening of the valve flap.

8. A container as set forth in claim 1, wherein the valve flap has two hinge portions.

9. A container as set forth in claim 1, comprising a plurality of valve flaps which are each movable between a closed position whereat it is seated on the seating area to close the evacuation port and an opened position whereat it is unseated from the seating area to open the evacuation port.

10. A method of evacuating the container set forth in claim 1, said method comprising the steps of:

moving the valve flap to the opened position;

removing gas from the receptacle through the evacuation port; and returning the valve flap to the closed position upon completion of the gas-removing step.

11. A container, comprising:

a container having a wall structure;

an evacuation port in the wall structure;

a label applied to the wall structure to vent gas from the container through the evacuation port to an outside environment, the label including a film layer forming a seat platform on which a seating area is located;

a film layer forming a flap platform on which a valve flap is located, the valve flap having a movable portion that pivots between a closed position about a hinge portion where the flap portion is seated on the seating area and opened position where the flap portion is unseated from the seating area, the film layer includes a cut that defines the valve flap;

a label-to-wall adhesive on the surface of the film layer forming the seat platform which is secured to the wall structure of the container;

a permanent seating adhesive having an annular pattern on the seating area which holds the valve flap in the closed position and prevents reopening of the valve flap; and a film-to-film adhesive that secures the film layers together.

12. A container as set forth in claim 11, wherein the label further includes a film layer forming a flap platform on which the valve flap is located.

13. A container as set forth in claim 11, wherein the film layer forming the flap platform includes a cut that defines the valve flap.

14. A container as set forth in claim 11, wherein the label further comprises:

a label-to-wall adhesive that secures the label structure to the exterior surface of the wall structure;

a film-to-film adhesive patterned on the seating adhesive that secures the film layer to the valve flap.

15. A container as set forth in claim 11, wherein the label includes the film layer forming a seat platform on which the seating area is located.

16. A container comprising:

a wall structure defining a receptacle;

an evacuation port in the wall structure through which gas can pass from the receptacle to an outside environment;

a seating area adjacent the evacuation port;

a valve flap, having a movable portion and two hinge portions about which the movable portion pivots, the movable portion pivots between a closed position and open position about the hinge portions whereat the valve flap is seated on the seating area to close the evacuation port and in the opened position whereas the valve flap lifts away from the seating area to open the evacuation port; and a seating adhesive on the seating area which holds a movable portion of the valve flap in the closed position and covers an exterior surface of a film layer and the seating adhesive has an annular shape wherein the adhesive holds the movable portion of the valve flap in the closed position:

wherein a label structure attached to the wall structure includes the film layer forming a seat platform on which the seating area is located wherein the film layer forming the seat platform includes an outer perimeter and an opening aligned with the evacuation port, and wherein the seating adhesive extends from the outer perimeter of the film layer to the opening of the film layer.

* * * * *